US009512857B2

(12) United States Patent
Tanaka et al.

(10) Patent No.: US 9,512,857 B2
(45) Date of Patent: Dec. 6, 2016

(54) LIQUID LIFTING DEVICE AND LIQUID LIFTING METHOD

(71) Applicant: Murata Manufacturing Co., Ltd., Kyoto (JP)

(72) Inventors: Nobuhira Tanaka, Kyoto (JP); Kiyoshi Kurihara, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/801,865

(22) Filed: Jul. 17, 2015

(65) Prior Publication Data

US 2015/0322969 A1 Nov. 12, 2015

Related U.S. Application Data

(63) Continuation of application No. PCT/JP2013/083303, filed on Dec. 12, 2013.

(30) Foreign Application Priority Data

Jan. 18, 2013 (JP) ..... 2013-006825

(51) Int. Cl.
*F04F 1/00* (2006.01)
*F04F 1/06* (2006.01)
(Continued)

(52) U.S. Cl.
CPC ..... *F04F 1/06* (2013.01); *E21B 43/121* (2013.01); *F04D 13/16* (2013.01); *F04D 17/10* (2013.01); *F04F 1/08* (2013.01); *F04F 3/00* (2013.01)

(58) Field of Classification Search
CPC ..... E21B 43/121; F04D 17/10; F04D 13/16; F04F 1/08; F04F 1/06
USPC ..... 417/108, 109
See application file for complete search history.

(56) References Cited

U.S. PATENT DOCUMENTS 298,990 A * 5/1884 Leedy ..... F04F 1/06 417/118
487,639 A * 12/1892 Pohle ..... F04F 1/18 417/108

(Continued)

FOREIGN PATENT DOCUMENTS

JP H11-193800 A 7/1999
JP 2000-240600 A 9/2000
JP 2010-196557 A 9/2010

OTHER PUBLICATIONS

International Search Report issued in Application No. PCT/JP2013/083303 dated Mar. 18, 2014.

(Continued)

*Primary Examiner* — Charles Freay
*Assistant Examiner* — Christopher Bobish
(74) *Attorney, Agent, or Firm* — Pearne & Gordon LLP

(57) ABSTRACT

A liquid lifting device includes: a liquid supply section storing liquid, a tank provided at a position higher than the liquid supply section; a liquid lifting pipe of which one end is inserted into the liquid in the liquid supply section and the other end is connected to the tank; an air pump configured to depressurize the interior of the tank; an air supply pipe in which one end portion of the air supply pipe is connected to the liquid lifting pipe via a branching section at a position halfway in the liquid lifting pipe, and an upright section is provided in the other end portion of the air supply pipe while standing upright from the one end portion; and an air valve provided in the other end portion of the air supply pipe and capable of being opened/closed with respect to the outside air.

6 Claims, 9 Drawing Sheets

(51) Int. Cl.

| | |
|---|---|
| ***F04D 17/10*** | (2006.01) |
| ***F04D 13/16*** | (2006.01) |
| ***E21B 43/12*** | (2006.01) |
| ***F04F 1/08*** | (2006.01) |
| ***F04F 3/00*** | (2006.01) |

(56) References Cited

U.S. PATENT DOCUMENTS 1,154,745 A * 9/1915 Browne ..... F03D 9/001 417/108
1,741,571 A * 12/1929 Ives ..... F04F 1/00 417/108
1,845,675 A * 2/1932 Martin ..... F04F 5/10 417/172
2,892,414 A * 6/1959 Griffith ..... C02F 3/223 417/109
4,647,272 A * 3/1987 Brown ..... F04F 1/18 417/109
4,738,313 A * 4/1988 McKee ..... F04F 1/08 166/372
4,990,061 A * 2/1991 Fowler ..... F04F 1/08 417/137
5,014,789 A * 5/1991 Clarke ..... E21B 43/122 166/372
6,162,020 A * 12/2000 Kondo ..... F04F 1/08 417/54
6,234,761 B1 * 5/2001 Kocsis ..... E21B 43/121 417/118
6,715,550 B2 * 4/2004 Vinegar ..... E21B 17/003 137/155
7,294,255 B2 * 11/2007 Kondo ..... C02F 3/12 210/151
8,047,808 B2 * 11/2011 Kondo ..... F04F 1/18 417/108
8,371,826 B1 * 2/2013 Johnson ..... F04F 1/06 417/118
2011/0076170 A1 * 3/2011 Fujisaki ..... F04B 45/047 417/415

OTHER PUBLICATIONS

Translation of Written Opinion issued in Application No. PCT/JP2013/083303 dated Mar. 18, 2014.

* cited by examiner

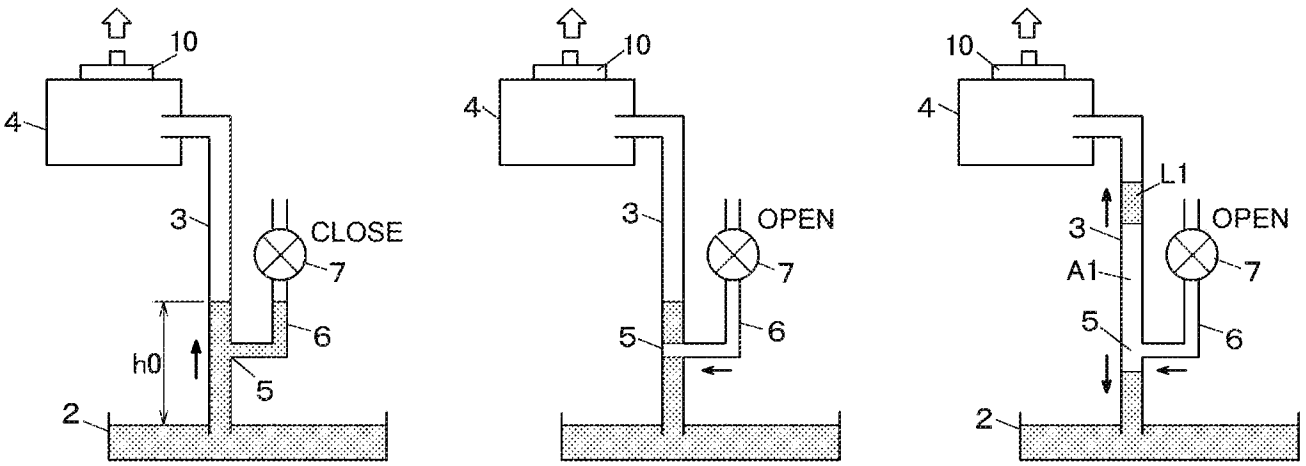
FIG. 3 A
FIG 3 B
FIG. 3 C
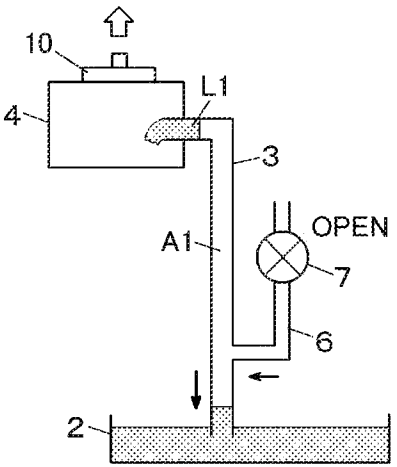
FIG. 3 D
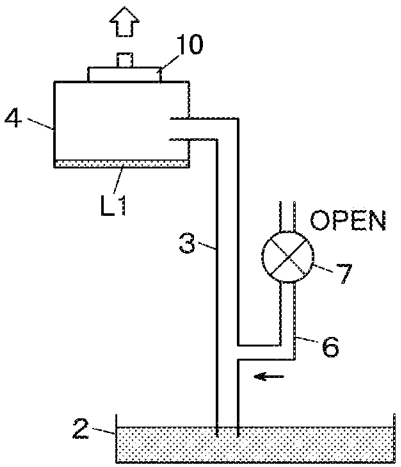
FIG. 3 E

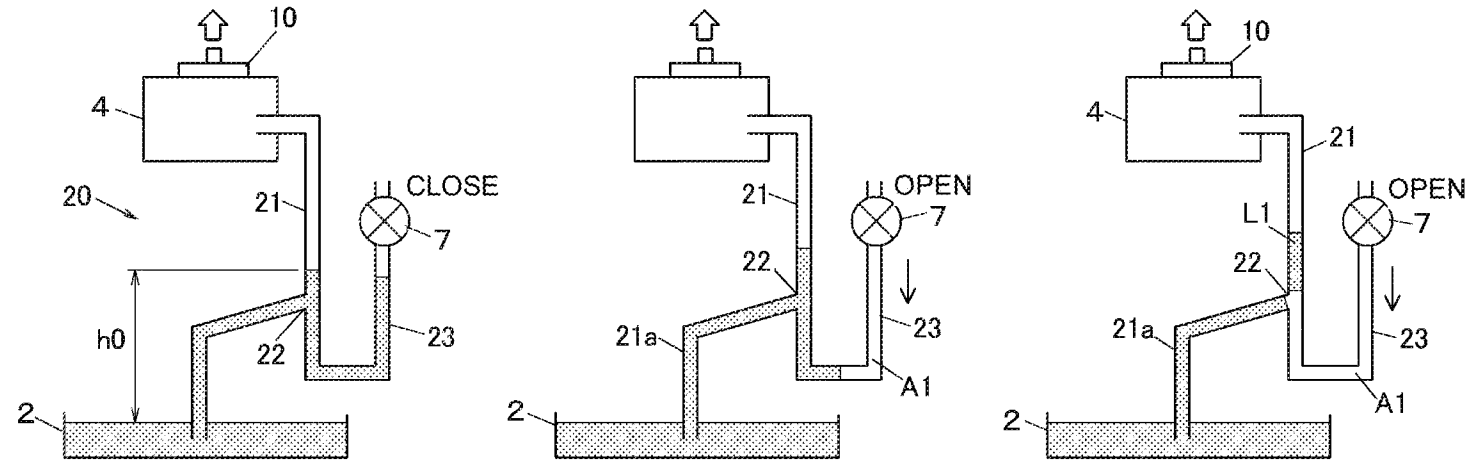
FIG. 7 A
FIG. 7 B
FIG. 7 C
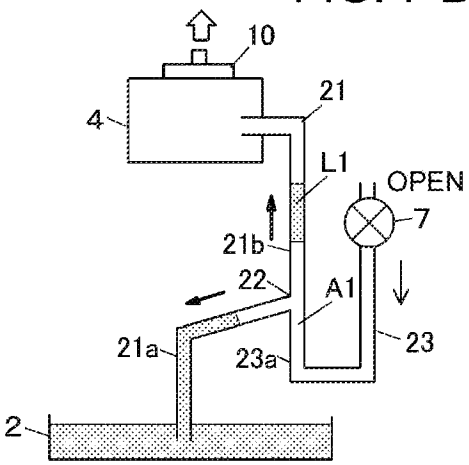
FIG. 7 D
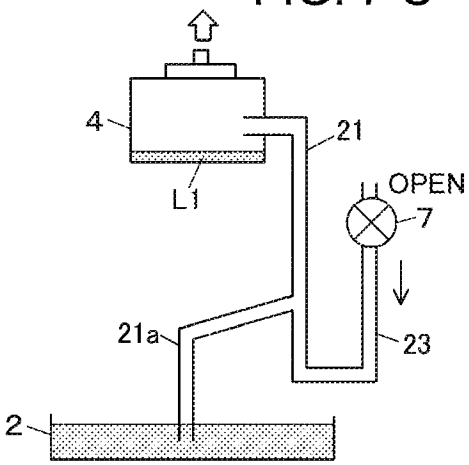
FIG. 7 E

LIQUID LIFTING DEVICE AND LIQUID LIFTING METHOD

BACKGROUND

Technical Field

The present disclosure relates to liquid lifting devices and liquid lifting methods configured to pump up liquid stored at a low position to a higher position using an air pump.

Background Art

Liquid lifting devices using an air pump (or vacuum pump) are a device in which one end of a liquid lifting pipe is inserted into a liquid source placed at a low position, the other end of the liquid lifting pipe is connected to a tank having an airtight structure and provided at a higher position, and the interior of the tank is depressurized by the air pump so as to pump up liquid in the liquid source to the tank through the liquid lifting pipe. However, with this type of liquid lifting device, liquid cannot be lifted to a height equal to or higher than a potential liquid lifting height corresponding to negative pressure generated by the air pump.

As such, Patent Document 1 proposes a liquid lifting device capable of lifting liquid to a height equal to or higher than a potential liquid lifting height by a vacuum pump. FIG. 10 shows an example of the proposed device, which includes a liquid source 100 provided at a low position, a liquid lifting pipe 101 whose one end is inserted into the liquid source 100, a tank 102 provided at a higher position and to which the other end of the liquid lifting pipe 101 is connected, and a vacuum pump 103 provided in the tank 102. The other end of the liquid lifting pipe 101 is disposed at a height equal to or higher than a potential liquid lifting height by the vacuum pump 103 relative to a liquid surface level of the liquid source 100. An air supply pipe 104 is connected to the liquid lifting pipe 101 at a position halfway in the liquid lifting pipe 101 and lower than the potential liquid lifting height by the vacuum pump 103. An air supply valve 105 is attached to the air supply pipe 104.

In the case where the vacuum pump 103 is driven in a state where the air supply valve 105 is closed, air in the tank 102 connected to the vacuum pump 103 and air in the liquid lifting pipe 101 are discharged so that the interiors thereof are depressurized. When the interior of the liquid lifting pipe 101 is under a predetermined negative pressure, a liquid surface in the liquid lifting pipe 101 rises up to a position higher than a branching section to which the air supply pipe 104 is connected. However, the liquid surface cannot reach the height of the tank 102. Here, in the case where the air supply valve 105 is opened for a short time, air is introduced into the air supply pipe 104 and stays in the branching section as an air bubble 106 in the liquid lifting pipe 101 so that the liquid in the liquid lifting pipe 101 is divided into upper side and lower side liquids. The air bubble 106 ascends due to a difference between pressure in the liquid lifting pipe 101 and pressure of the air bubble 106 and a buoyant force that the air bubble 106 receives. As such, a liquid column positioned on the upper side of the air bubble 106 is pushed upward and consequently flows into the tank 102.

However, in the liquid lifting device configured as described above, since the air supply pipe 104 which is short in length is connected to a side portion of the liquid lifting pipe 101 and the air supply valve 105 is attached to the air supply pipe 104, liquid makes contact with the air supply valve 105. Because of this, impurities contained in the liquid adhere to the valve 105, which raises a risk that the open/close operation of the valve 105 is carried out incorrectly. In addition, in the case where the air supply valve 105 is opened for more than a predetermined time, there arises a risk that the liquid flows out through the air supply valve 105.

Another embodiment, which is different from the liquid lifting device discussed above, is also disclosed in Patent Document 1. FIG. 11 shows an example of the stated embodiment, where an air delivery pipe 104 is inserted into the liquid lifting pipe 101 and a lower end thereof is opened at a position lower than the potential liquid lifting height by the vacuum pump 103. To an upper end of the air delivery pipe 104, an openable/closable valve 105 that is intermittently opened/closed is attached. In this embodiment, because the openable/closable valve 105 is attached to the upper end of the air delivery pipe 104 projecting above the liquid lifting pipe 101, there is not a risk that liquid makes contact with the openable/closable valve 105, and a problem that the liquid flows out of the air delivery pipe 104 is not present as well.

However, in this liquid lifting device, since the air delivery pipe 104 is inserted into the liquid lifting pipe 101, a cross-sectional area of the liquid lifting pipe 101 is decreased by a cross-sectional area of the air delivery pipe 104 and a circular gap between the liquid lifting pipe 101 and the air delivery pipe 104 is a liquid flow path. An air layer introduced through the air delivery pipe 104 stays at a leading end of the air delivery pipe 104 as the air bubble 106; this air bubble 106 needs to divide the liquid filled in the circular gap between the liquid lifting pipe 101 and the air delivery pipe 104 into upper side and lower side liquids. However, in order to divide the liquid filled in the circular gap into the upper and lower side liquids, a large air bubble needs to be created. Patent Document 1 discloses that operation to open the openable/closable valve 105 for a short time is repeatedly carried out so that a plurality of air bubbles are intermittently discharged and the plurality of discharged air bubbles are gathered as they ascend, whereby a shell-shaped air bubble (slug flow) is formed so as to occupy the caliber of the liquid lifting pipe 101 (see paragraph 0022). However, it is not always the case that a plurality of air bubbles are gathered to be formed into a single bubble in the circular space, which raises a risk that the liquid filled in the circular gap cannot be divided into upper and lower side liquids and a desired liquid lifting effect cannot be achieved. Further, in the case where the invention of Patent Document 1 is applied to a small liquid lifting device including the liquid lifting pipe 101 with a relatively small diameter, there is a risk that the air bubble keeps staying at the leading end of the air delivery pipe 104 due to influence of the surface tension of liquid and cannot ascend in the circular gap of the liquid lifting pipe 101.

Patent Document 1: Japanese Unexamined Patent Application Publication No. 2000-240600

BRIEF SUMMARY

The present disclosure provides a liquid lifting device and a liquid lifting method configured to use an air pump and capable of lifting liquid to a height equal to or higher than a potential liquid lifting height of the stated pump.

The present disclosure provides a liquid lifting device that includes: a liquid supply section in which liquid is stored; a tank provided at a position higher than the liquid supply section; a liquid lifting pipe of which one end is inserted into the liquid stored in the liquid supply section and the other end is connected to the tank; an air pump configured to depressurize the interior of the tank and the interior of the liquid lifting pipe; an air supply pipe in which one end portion of the air supply pipe is connected to the liquid lifting pipe via a branching section at a position halfway in the liquid lifting pipe, and an upright section is provided in the other end portion of the air supply pipe while standing upright from the one end portion; and an air valve provided in the other end portion of the air supply pipe and capable of being opened/closed with respect to the outside air. Further, in the stated liquid lifting device, a height from a liquid surface in the liquid supply section to the other end of the liquid lifting pipe is larger than a potential liquid lifting height of the air pump, and a height from the liquid surface in the liquid supply section to the branching section is smaller than the potential liquid lifting height of the air pump.

In the present disclosure, in order to lift liquid to a position higher than a potential liquid lifting height of the air pump, the air valve is intermittently opened to introduce air through the air supply pipe; then the liquid in the liquid lifting pipe is pushed up by an air layer having been introduced, and consequently lifted to the tank. In the case where the air pump is driven while the air valve is closed, the interior of the tank and the interior of the liquid lifting pipe are depressurized so that the liquid in the liquid supply section is pumped up to the liquid lifting pipe and rises up to the potential liquid lifting height of the air pump. Since the branching section is disposed at a position lower than the potential liquid lifting height of the air pump, the branching section is filled with the liquid. At this time, although part of the liquid also enters the air supply pipe, the liquid surface cannot rise up to a position where the air valve is provided because the air valve is closed. In other words, the air valve will not make contact with the liquid. Next, in the case where the air valve is opened while the air pump is driven, an air layer is introduced into the branching section through the air supply pipe so that the liquid in the liquid lifting pipe is divided into upper side and lower side liquids by the air layer. Because the liquid positioned above the air layer is lighter than the mass of liquid which can be lifted by the air pump, the liquid is pushed up by a difference between negative pressure generated by the air pump and pressure of the air layer and a buoyant force of the air layer, and consequently flows into the tank. The above operation is repeated by opening the air valve intermittently so that liquid is stored in the tank.

In the present disclosure, one end portion of the air supply pipe is connected to the liquid lifting pipe via the branching section, and an air valve is attached to the other end portion of the air supply pipe. Upon opening the air valve, an air layer introduced through the air supply pipe forms a single air bubble in the liquid lifting pipe so that the liquid in the liquid lifting pipe is divided into upper side and lower side liquids by the above air bubble. This makes it possible to smoothly lift the liquid above the air bubble by negative pressure generated by the air pump. Since the air supply pipe does not influence the cross-sectional area of the liquid lifting pipe, even if the liquid lifting pipe is a small pipe, the air supply pipe does not obstruct movement of the air bubble ascending in the liquid lifting pipe so that liquid can be smoothly lifted. In addition, because liquid does not make contact with the air valve, impurities contained in the liquid will not adhere to the valve.

The upright section of the air supply pipe may extend up to a position higher than the potential liquid lifting height of the air pump, and the air valve may be attached to the upright section at a position higher than the potential liquid lifting height of the air pump. In this case, even if the interior of the air supply pipe becomes under negative pressure for some reason and liquid flows into the air supply pipe, the liquid will not make contact with the air valve because the air valve is provided at the position higher than the potential liquid lifting height of the air pump.

Note that the attachment position of the air valve is not limited to the upright section of the air supply pipe; for example, an upward-facing upright section and a downward-facing section may be continuously formed in the other end portion of the air supply pipe, and the air valve may be attached to the downward-facing section. In this case, if an upper end of the upright section is positioned higher than the potential liquid lifting height of the air pump, liquid cannot flow over the upright section, whereby the liquid does not make contact with the air valve.

The one end portion and the other end portion of the air supply pipe may respectively stand upright to form approximately a U shape as a whole, and the one end portion of the air supply pipe be connected in a straight line to a portion of the liquid lifting pipe on the tank side via the branching section. In this case, because an air layer formed within the air supply pipe flows into the liquid lifting pipe without necessarily meandering, the air layer is unlikely to be deformed. This makes it easy for the liquid in the liquid lifting pipe to be divided into upper and lower side liquids, whereby the effect of liquid lifting operation can be improved. In addition, since the air supply pipe is bent while forming a U shape, liquid can stay in the air supply pipe. With this configuration, liquid in the air supply pipe is pushed by an air layer, which is introduced when the air valve is opened, and rises up together in the liquid lifting pipe. This makes it possible to lift a larger amount of liquid.

A cross-sectional area of the air supply pipe may be larger than a cross-sectional area of the liquid lifting pipe. In this case, since a volume of the interior of the air supply pipe is larger, a mass of air layer having flowed into the branching section of the liquid lifting pipe can be made large. This makes it easy for the liquid in the liquid lifting pipe to be divided into upper and lower side liquids, thereby enhancing the effect of liquid lifting operation.

In the case where the air valve is opened while the air pump is being driven and an air layer is being allowed to flow into the branching section through the air supply pipe, the valve may be opened/closed for a short time or opened continuously. In particular, in the case where the air valve is continuously opened until a liquid column positioned above the air layer has been pumped up to the tank, the air layer is not dispersed and forms a large single mass of air; then, the liquid column positioned above the air layer is quickly lifted because the air layer is nearly under the atmospheric pressure.

According to the present disclosure, as described above, because one end of the air supply pipe is connected to the liquid lifting pipe via the branching section and the air valve is attached to the other end of the air supply pipe, an air layer introduced through the air supply pipe forms a single air bubble in the liquid lifting pipe. This makes it possible to smoothly lift the liquid on the upper side relative to the air bubble by negative pressure generated by the air pump. Since the air supply pipe does not reduce the cross-sectional area of the liquid lifting pipe, the air supply pipe does not obstruct movement of the air bubble ascending in the liquid lifting pipe so that the liquid is smoothly lifted. Further, because liquid does not make contact with the air valve, impurities contained in the liquid will not adhere to the valve, whereby open/close capability of the valve can be maintained over a long time.

BRIEF DESCRIPTION OF THE SEVERAL VIEWS OF THE DRAWINGS

FIGS. 3A-3E include diagrams illustrating an example of liquid lifting operation of a liquid lifting device of the first embodiment.

FIGS. 7A-7E include diagrams illustrating liquid lifting operation of a liquid lifting device of the second embodiment.

DESCRIPTION OF EMBODIMENTS

First Embodiment

Figure 1:
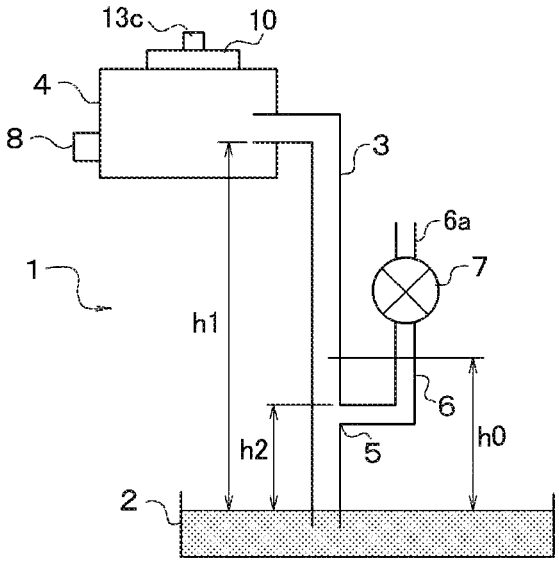
FIG. 1 is a schematic diagram illustrating a first embodiment of a liquid lifting device according to the present disclosure.

FIG. 1 shows a first embodiment of a liquid lifting device according to the present disclosure. A device 1 includes a liquid supply section 2 provided at a low position, a liquid lifting pipe 3 extending in a vertical direction whose one end is inserted into liquid stored in the liquid supply section 2, a tank 4 which has an airtight structure and is provided at a higher position and to which the other end of the liquid lifting pipe 3 is connected, and an air pump 10 provided in the tank 4. Although the liquid supply section 2 in the present embodiment is a storage tank whose upper side is open, the liquid supply section may be a tank of which a part is opened to the outside air. The air pump 10 is provided in an upper wall of the tank 4 so as not to be in contact with liquid that flows into the tank 4. A liquid level sensor 8 is provided in a side wall of the tank 4 and so configured as to stop the air pump 10 when a liquid surface in the tank 4 reaches the height of the liquid level sensor 8. The other end portion of the liquid lifting pipe 3 extends up to a position higher than a potential liquid lifting height by the air pump 10 and is connected to a side wall of the tank 4. Although a position of a connecting portion between the liquid lifting pipe 3 and the tank 4 is not limited to the side wall, the liquid lifting pipe 3 is open at a position higher than a liquid surface level of the liquid level sensor 8 so that liquid in the tank 4 does not flow back to the liquid lifting pipe 3 before the liquid reaches the liquid surface level of the liquid level sensor 8.

A branching section 5 formed in a T shape is provided at a position halfway in the liquid lifting pipe 3. One end portion of the air supply pipe 6 is connected to the branching section 5. The other end portion of the air supply pipe 6 stands upright and an upper end of an upright section 6*a* thereof is opened to the outside air. An openable/closable air valve 7 is attached to the upright section 6*a*. It is sufficient that the air valve 7 is an air valve capable of passing/blocking an air flow, and the air valve 7 may be an electromagnetic valve capable of being opened/closed in a short time. The air pump 10, the liquid level sensor 8, and the air valve 7 are connected to a control unit (not shown) and controlled in accordance with an operational sequence, which will be described later.

For example, in the case where density of liquid is taken as ρ, a maximum negative pressure generated by the air pump 10 is taken as P, and the acceleration of gravity is taken as g, a potential liquid lifting height h0 by the air pump 10 can be given by the following formula.

$$h0=P/\rho g$$

As such, in the case where, for example, the liquid is water and the maximum negative pressure generated by the air pump 10 is 2 kPa, the potential liquid lifting height h0 by the air pump 10 is approximately 20 cm.

In the case where a height difference between the liquid surface in the liquid supply section 2 and the other end portion of the liquid lifting pipe 3 is taken as h1, and a height difference between the liquid surface in the liquid supply section 2 and the branching section 5 is taken as h2, h1 and h2 are set so as to satisfy the following formula.

$$h1>h0, \text{ and } h2<h0$$

The upright section 6*a* of the air supply pipe 6 may extend up to a position higher than the potential liquid lifting height h0 of the air pump 10, and the air valve 7 may be attached to the upright section 6*a* of the air supply pipe 6 at a position higher than the potential liquid lifting height h0 of the air supply pipe 6. Accordingly, liquid will not make contact with the air valve 7 even if the interior of the air supply pipe 6 is highly depressurized to any extent. It is unnecessary for the air valve 7 to be positioned higher than the potential liquid lifting height h0.

Figure 2:
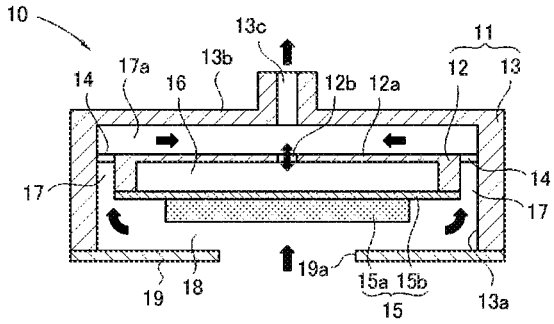
FIG. 2 is a cross-sectional view of a piezoelectric micro blower as an example of an air pump.

Although any existing pressure pump may be used as the air pump 10, a piezoelectric micro blower with a suction inlet being connected to the tank 4 and a discharge outlet being opened to the outside air is employed in the present embodiment. This piezoelectric micro blower 10 is the same as that disclosed in Japanese Unexamined Patent Application Publication No. 2011-27079, for example. An example of a structure of the piezoelectric micro blower 10 is illustrated in FIG. 2. As shown in FIG. 2, a blower main body 11 includes an inner case 12 and an outer case 13 that covers an outer side portion of the inner case 12 in a contactless manner with a predetermined gap therebetween. The inner case 12 is held inside the outer case 13 with the predetermined gap therebetween, and is elastically supported with respect to the outer case 13 via a spring coupling unit 14. With this, in the case where the inner case 12 vibrates in the up-down direction along with resonance driving of a vibration plate 15 to be explained later, the vibration thereof is suppressed from being leaked to the outer case 13. An air inflow path 17 is formed between the inner case 12 and the outer case 13.

The inner case 12 is formed in a shape whose cross-section is a rectangle with one side open so that the lower side of the inner case 12 is opened, the vibration plate 15 is fixed so as to close the opening of the inner case 12, and a first blower chamber 16 is formed between the inner case 12 and the vibration plate 15. The vibration plate 15 has a unimorph structure in which, for example, a piezoelectric element 15*a* formed of piezoelectric ceramics is attached to a central portion of a diaphragm 15*b* formed of a thin elastic metal plate. By applying a voltage of a predetermined frequency to the piezoelectric element 15*a*, the overall vibration plate 15 is resonance-driven in a bending mode. In this example, the piezoelectric element 15*a* is fixed to a surface of the diaphragm 15*b* on the opposite side to the first blower chamber.

A first wall 12*a* is provided on a section of the inner case 12 that forms one wall surface of the first blower chamber 16 and opposes the vibration plate 15. In the case where the first wall 12*a* is formed of a thin elastic metal plate and the vibration plate 15 is resonance-driven in a predetermined mode, the first wall 12*a* may be so configured as to be excited along with the resonance-driving of the vibration plate 15. In a section of the first wall 12*a* opposing a central portion of the vibration plate 15, there is formed a first opening 12*b* that allows the interior of the first blower chamber 16 and the exterior thereof to communicate with each other. A second wall 13*b* is provided on a section of the outer case 13 that opposes the first wall 12*a*. A second opening 13*c* is formed in a central portion of the second wall 13*b*, that is, in a section of the second wall 13*b* opposing the first opening 12*b*. The second opening 13*c* serves as an air discharge outlet. A predetermined inflow space 17*a* is formed between the first wall 12*a* and the second wall 13*b*, and this inflow space 17*a* configures a part of the above-mentioned inflow path 17. The inflow space 17*a* has a function to guide the air introduced through the inflow path 17 to the vicinity of the first opening 12*b* as well as the second opening 13*c*.

A third wall 19 is provided on the lower surface side of the outer case 13, that is, on the opposite side to the first blower chamber 16, with the vibration plate 15 interposed therebetween, so as to form a second blower chamber 18 between the vibration plate 15 and the stated third wall 19. In a central portion of the third wall 19, there is formed a third opening 19*a* that allows the exterior to communicated with the second blower chamber 18. The third opening 19*a* serves as an air suction inlet. The volume of the second blower chamber 18 and an opening area of the third opening 19*a* are so set as to form a pseudo resonance space along with the vibration of the vibration plate 15. The second blower chamber 18 and the inflow path 17 are connected to each other. This causes the air having been introduced into the second blower chamber 18 through the third opening 19*a* to be supplied to the inflow space 17*a* passing through the inflow path 17.

Applying a voltage of a predetermined frequency to the piezoelectric element 15*a* causes the vibration plate 15 to be resonance-driven in a first or third resonant mode, which periodically changes the volume of the first blower chamber 16. The air within the inflow space 17*a* is sucked into the first blower chamber 16 passing through the first opening 12*b* when the volume of the first blower chamber 16 increases; in contrast, when the volume of the first blower chamber 16 decreases, the air in the first blower chamber 16 is discharged into the inflow space 17*a* passing through the first opening 12*b*. Because the vibration plate 15 is driven at a high frequency, an air flow of high speed and high energy discharged into the inflow space 17*a* through the first opening 12*b* passes the inflow space 17*a* and is discharged through the second opening 13*c*. At this time, the above air flow is discharged while sucking in peripheral air within the inflow space 17*a*. This generates a continuous air flow moving from the inflow path 17 toward the inflow space 17*a* so that the air is continuously discharged as a jet flow through the second opening 13*c*. Each air flow is indicated by an arrow in FIG. 2. In particular, by exciting the first wall 12*a* along with the resonance-driving of the vibration plate 15, an amount of discharged air can be remarkably increased.

Because the micro blower (air pump) 10 having the above-discussed structure is not equipped with a check valve, a suction inlet 19*a* and a discharge outlet 13*c* communicate with each other when the pump is not driven. As such, when the driving of the air pump 10 is stopped, the interior of the tank 4 as well as the interior of the liquid lifting pipe 3 instantaneously returns to a state under the atmospheric pressure so that liquid left in the liquid lifting pipe 3 can be returned to the liquid supply section 2 without necessarily being lifted. As a result, the lifting amount of liquid can be easily controlled.

Explanation of Operations

Next, an example of operation of the liquid lifting device 1 having the above-discussed structure will be described with reference to FIGS. 3A-3E. First, in the case where the air pump 10 is driven with the air valve 7 being closed, the interior of the tank 4 is depressurized and the interior of the liquid lifting pipe 3 connected to the tank 4 is also depressurized. With this, liquid in the liquid supply section 2 is pumped up to the liquid lifting pipe 3 and the liquid surface thereof rises up to the potential liquid lifting height h0 by the air pump 10. In other words, the liquid surface rises up to a position higher than the branching section 5, but cannot reach the tank 4. At this time, part of the liquid also enters the air supply pipe 6 passing through the branching section 5; however, air pressure inside the air supply pipe 6 is raised due to the rise of the liquid surface because the air valve 7 is closed, so that the liquid surface cannot rise up to the position where the air valve 7 is provided. That is, the liquid will not make contact with the air valve 7. This state is shown in FIG. 3A.

Subsequently, in the case where the air valve 7 is opened while the air pump 10 is driven, the outside air is introduced into the branching section 5 passing through the air supply pipe 6 so that the liquid in the liquid lifting pipe 3 is divided into upper and lower side liquids. This state is shown in FIG. 3B.

As the time in which the air valve 7 is opened passes, an air layer A1 having entered the liquid lifting pipe 3 expands (see FIG. 3C). Since an amount of an upper side liquid column L1 divided by the air layer A1 is equal to or less than the mass capable of being pumped up by negative pressure generated by the air pump 10, the liquid column L1 is lifted by a difference between negative pressure within the liquid lifting pipe 3 and the internal pressure of the air layer A1 and a buoyant force of the air layer A1. A liquid surface positioned below the branching section 5 in the liquid lifting pipe 3 gradually lowers due to the pressure of air introduced through the air supply pipe 6.

As the time in which the air valve 7 is opened further passes, the liquid column L1 rises up in the liquid lifting pipe 3 and flows into the tank 4, as shown in FIG. 3D. When the liquid column L1 has completely flowed into the tank 4, the interior of the liquid lifting pipe 3 and the interior of the air supply pipe 6 are made to be substantially under the atmospheric pressure because the tank 4, the liquid lifting pipe 3, and the air supply pipe 6 communicate with one another. As a result, the interior of the liquid lifting pipe 3 is substantially vacant as shown in FIG. 3E. Thereafter, in the case where the air valve 7 is closed, the tank 4 and the liquid lifting pipe 3 become under negative pressure again, and return to the state of FIG. 3A.

In the present example of operation, the air valve 7 is not opened/closed for a short time, but is kept being opened during one liquid lifting cycle. As such, a single large air layer A1 can be formed in the liquid lifting pipe 3 so that the liquid in the liquid lifting pipe 3 can be easily divided; further, because the internal pressure of the air layer A1 becomes close to the atmospheric pressure, a difference between the negative pressure inside the liquid lifting pipe 3 and the internal pressure of the air layer A1 becomes larger, whereby the liquid column L1 on the upper side relative to the air layer A1 can be quickly lifted.

In the above explanation, although the air valve 7 is kept being opened until the liquid column L1 has completely flowed into the tank 4, the air valve 7 may be closed at the timing just when the liquid column L1 enters into the tank 4 or at a stage before the liquid column L1 enters thereinto (for example, FIG. 3C or FIG. 3D). In this case, since the internal pressure of the liquid lifting pipe 3 does not rise up to the atmospheric pressure, the next liquid lifting operation can be started before the liquid in the liquid lifting pipe 3 has completely returned to the liquid supply section 2, which improves the efficiency of liquid lifting operation.

In the manner described above, by opening/closing the air valve 7 while the air pump 10 is driven, a liquid column in the liquid lifting pipe 3 can be divided and the liquid can be lifted up to the tank 4 disposed at a position higher than the potential liquid lifting height h0 of the air pump 10 by making use of force of the air layer A1. A method for opening/closing the air valve 7 is not necessarily needed to be such that a short-time opening/closing operation is repeated as disclosed in Patent Document 1, and may be such that the valve is opened/closed at a certain time interval, whereby the large air layer A1 can be formed within the liquid lifting pipe 3 so that the liquid column L1 on the upper side relative to the air layer can be lifted with certainty.

Figure 4A:
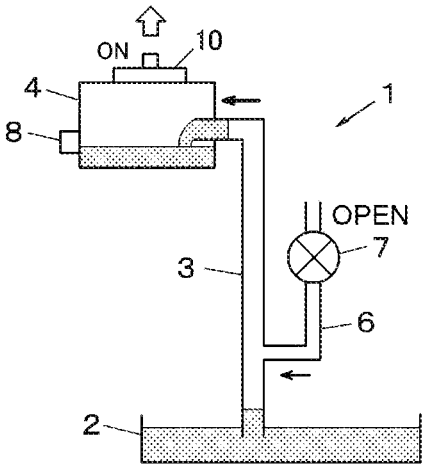
FIGS. 4A and 4B include diagrams illustrating operation of a liquid lifting device of the first embodiment when an air pump is OFF.
Figure 4B:
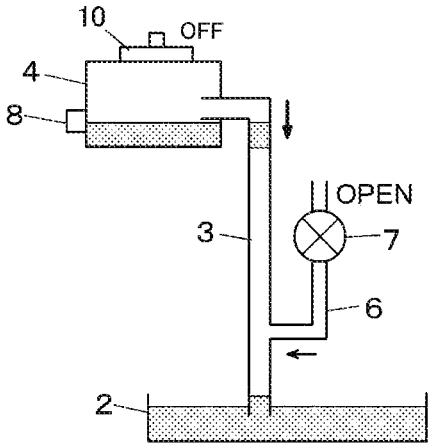

FIGS. 4A and 4B include diagrams illustrating operation of the device when the air pump 10 is stopped. As shown in FIG. 4A, the liquid level sensor 8 is provided in the tank 4, and the air pump 10 is stopped at a time when the liquid surface in the tank 4 reaches the level of the liquid level sensor 8. In this case, even if liquid is left in the liquid lifting pipe 3, the liquid remaining in the liquid lifting pipe 3 does not flow into the tank 4 and all the liquid in the liquid lifting pipe 3 returns to the liquid supply section 2, as shown in FIG. 4B, because the interior of the tank 4 and the interior of the liquid lifting pipe 3 instantaneously return to a state under the atmospheric pressure when the air pump 10 is stopped. As such, the surface level in the tank 4 can be controlled with precision.

Explanation of Another Operation

FIGS. 5A-5G include diagrams illustrating another example of operation of the liquid lifting device 1. This example of operation indicates a case where the air valve 7 is opened/closed a plurality of times during one liquid lifting operation cycle.

First, in the case where the air pump 10 is driven while the air valve 7 is closed, the interior of the tank 4 is depressurized and the interior of the liquid lifting pipe 3 connected to the tank 4 is also depressurized. With this, liquid in the liquid supply section 2 is pumped up to the liquid lifting pipe 3 and a liquid surface in the liquid lifting pipe 3 reaches a height h3 (see FIG. 5A). The height h3 of the liquid surface is set so as to satisfy the following formula in order to lift a set amount of liquid all the time by repeating the operation.

$$h3<(h0+h2)/2$$

Figure 5A:
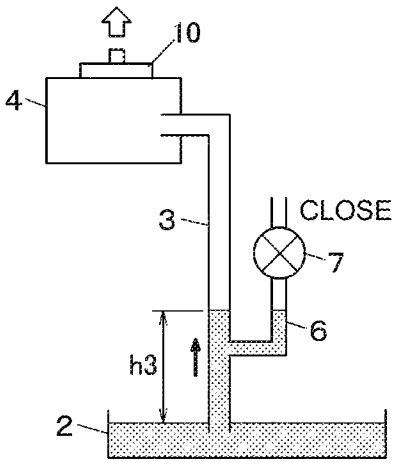
FIGS. 5A-5G include diagrams illustrating another example of operation of a liquid lifting device of the first embodiment.
Figure 5B:
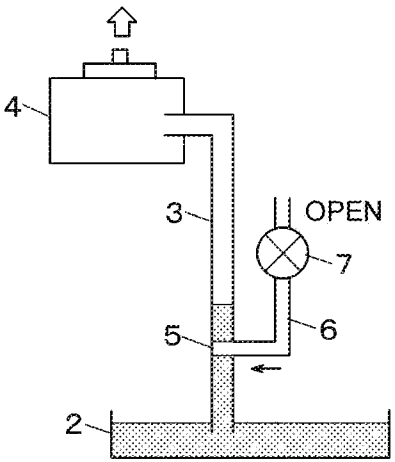

At this time, part of the liquid also enters the air supply pipe 6 passing through the branching section 5, but the liquid surface thereof cannot rise up to the position of the air valve 7. This is because the rise of the liquid surface increases the air pressure within the air supply pipe 6 due to the air valve 7 being closed. In other words, liquid will not make contact with the air valve 7. In the case where the air valve 7 is opened at the instant of the state shown in FIG. 5A, the outside air is introduced into the branching section 5 passing through the air supply pipe 6 so that the liquid in the liquid lifting pipe 3 is divided into upper and lower side liquids. This state is shown in FIG. 5B.

Figure 5C:
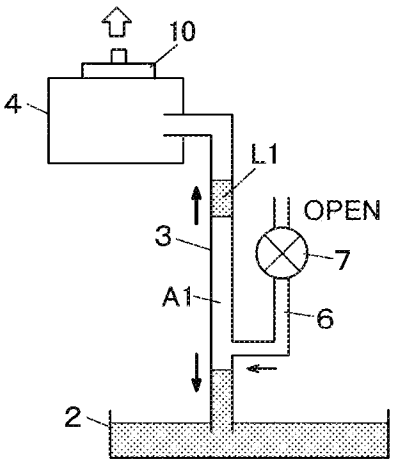

As the time in which the air valve 7 is opened passes, the air layer A1 having entered the liquid lifting pipe 3 expands (see FIG. 5C). Since an amount of the upper side liquid column L1 divided by the air layer A1 is equal to or less than the mass capable of being pumped up by negative pressure generated by the air pump 10, the liquid column is lifted by a difference between the negative pressure within the liquid lifting pipe 3 and the internal pressure of the air layer A1 and a buoyant force of the air layer A1. The liquid surface below the branching section 5 of the liquid lifting pipe 3 gradually lowers due to the pressure of air introduced through the air supply pipe 6.

Figure 5D:
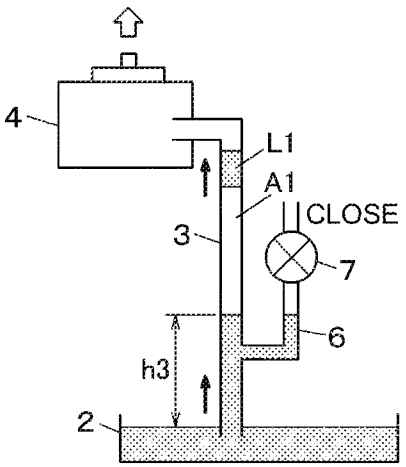
Figure 5E:
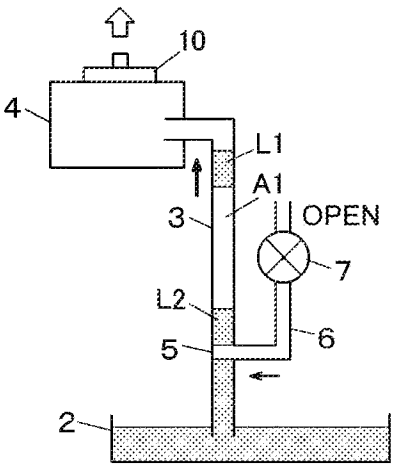

In FIG. 5D, upon closing the air valve 7, because a first liquid column L1 in the liquid lifting pipe 3 rises up and the air pressure of the air layer A1 lowers, liquid is pumped up to the liquid lifting pipe 3 from the liquid supply section 2. In the case where the air valve 7 is opened at the instant of the liquid surface in the liquid lifting pipe 3 having reached the height h3 again, air is introduced through the air supply pipe 6 and the liquid in the liquid lifting pipe 3 is divided into upper and lower side liquids by the air layer which has reached the branching section 5, as shown in FIG. 5E. At this time, a second liquid column L2 is formed.

Figure 5F:
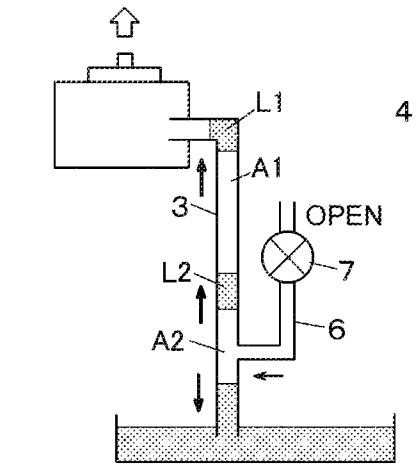
Figure 5G:
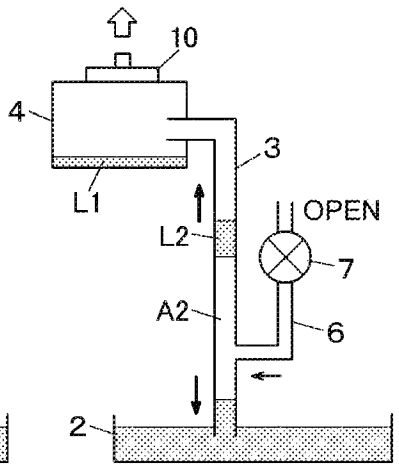

As the time in which the air valve 7 is opened passes, an air layer A2 expands so that the first and second liquid columns L1 and L2 rise up in the liquid lifting pipe 3 (see FIG. 5F). Subsequently, when the first liquid column L1 enters into the tank 4, the second liquid column L2 rises up in the liquid lifting pipe 3 (see FIG. 5G) because negative pressure generated by the air pump 10 acts on a space above the second liquid column L2. Here, in the case where the air valve 7 is closed, the interior of the liquid lifting pipe 3 and the interior of the air supply pipe 6 become under negative pressure and the operation returns to the state of FIG. 5D. Thereafter, the operations from FIG. 5D through FIG. 5G are repeated.

As described thus far, by intermittently opening/closing the air valve 7 during one liquid lifting operation cycle, a plurality of liquid columns can be generated in the liquid lifting pipe 3 and the liquid can be poured into the tank 4 little by little. As such, operation of lifting a minute amount of liquid can be precisely controlled.

Second Embodiment

Figure 6:
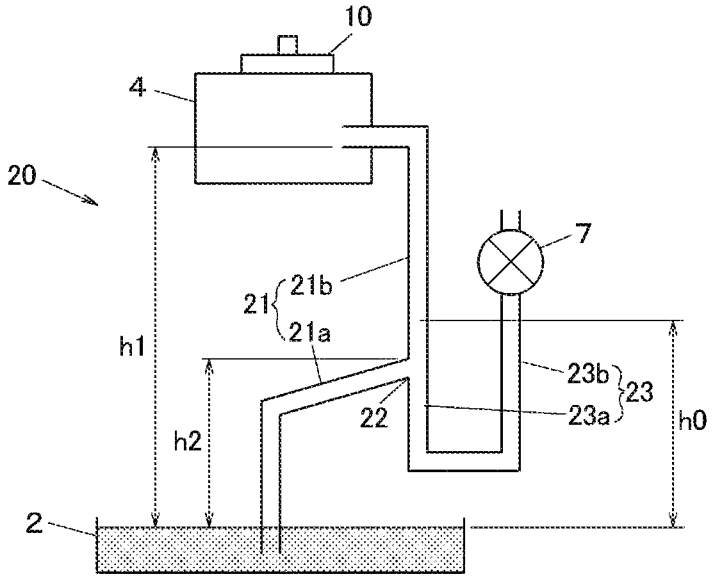
FIG. 6 is a schematic diagram illustrating a second embodiment of a liquid lifting device according to the present disclosure.

FIG. 6 illustrates a second embodiment of a liquid lifting device according to the present disclosure. In a device 20, the same constituent elements as those in the device 1 of the first embodiment are given the same reference numerals and redundant descriptions thereof will be omitted.

In the second embodiment, a lower section 21*a* and an upper section 21*b* of a liquid lifting pipe 21 are bent at a branching section 22, and one end portion 23*a* of an air supply pipe 23 is connected to the branching section 22. The upper section 21*b* of the liquid lifting pipe 21 extends in the vertical section. One end portion 23*a* and the other end portion 23*b* of the air supply pipe 23 respectively stand upright so that the air supply pipe 23 is formed in a U shape as a whole. The other end portion (upright section) 23*b* of the air supply pipe 23 extends up to a position higher than the one end portion 23*a*. The one end portion 23*a* of the air supply pipe 23 is connected in a straight line to the upper section (portion on the tank side) 21*b* of the liquid lifting pipe 21 via the branching section 22.

Operation of the liquid lifting device 20 of the second embodiment will be described with reference to FIGS. 7A-7E. In the case where the air pump 10 is driven while the air valve 7 is closed, the interior of the tank 4 is depressurized and the interior of the liquid lifting pipe 21 connected to the tank 4 is also depressurized. This causes liquid in the liquid supply section 2 to be pumped up to the liquid lifting pipe 21, and a liquid surface thereof rises up to the potential liquid lifting height h0 by the air pump 10. This state is shown in FIG. 7A. Since the liquid surface rises up to a position higher than the branching section 22, part of the liquid also enters the air supply pipe 23 through the branching section 22. Because the air supply pipe 23 is bent, a larger amount of liquid enters the air supply pipe 23 than in the first embodiment. Note that the liquid surface cannot rise up to the position of the air valve 7 because the air valve 7 is closed.

Next, in the case where the air valve 7 is opened while the air pump 10 is driven, the outside air is introduced into the air supply pipe 23 so that part of the liquid in the air supply pipe 23 is pushed up, by the air layer A1 having been introduced, along with the liquid in the liquid lifting pipe 21 (particularly in the upper section 21*b*). This state is shown in FIG. 7B. Note that a remaining part of the liquid in the air supply pipe 23 returns to the liquid supply section 2 passing through the lower section 21*a* of the lifting pipe 21.

Subsequently, upon the air layer A1 having reached the branching section 22, the liquid in the liquid lifting pipe 21 is divided into upper and lower side liquids. This state is shown in FIG. 7C. Because the liquid lifting pipe 21 and the air supply pipe 23 are connected to each other in a straight line at the branching section 22, the air layer A1 ascends from the air supply pipe 23 toward the liquid lifting pipe 21 without necessarily being deformed into bubbles.

Further, as the time in which the air valve 7 is opened passes, the upper side liquid column L1 having been divided is pushed up passing through the liquid lifting pipe 21, while the lower side liquid column descends passing through the liquid lifting pipe 21. This state is shown in FIG. 7D.

Subsequently, upon the liquid column L1 on the upper side relative to the air layer A1 having flowed into the tank 4, almost all the liquid in the liquid lifting pipe 21 (including the liquid in the lower section 21*a*) returns to the liquid supply section 2 because the interior of the liquid lifting pipe 21 and the interior of the air supply pipe 23 communicate with the outside air. This state is shown in FIG. 7E.

In the case where the air valve 7 is closed again from this state, the interior of the liquid lifting pipe 21 and the interior of the air supply pipe 23 are depressurized and the operation returns to the state of FIG. 7A. Thereafter, the operations from FIG. 7A through FIG. 7E are repeated. Also, in this case, the air valve 7 is kept being opened continuously until the liquid column L1 has flowed into the tank 4. However, if the liquid in the liquid lifting pipe 21 has been divided into upper and lower side liquids, the air valve 7 may be closed before the liquid column L1 flows into the tank 4.

In the second embodiment, because the one end portion 23*a* of the air supply pipe 23 and the upper section (portion on the tank side) 21*b* of the liquid lifting pipe 21 are connected to each other in a straight line, the air layer A1 introduced through the air supply pipe 23 flows into the upper section 21*b* of the liquid lifting pipe 21 without necessarily being deformed, whereby liquid in the liquid lifting pipe 21 can be divided into upper and lower side liquids with certainty. In addition, because the air supply pipe 23 is bent, liquid in the air supply pipe 23 also rises up together in the liquid lifting pipe 21 until the air layer A1 reaches the branching section 22 after the air valve 7 is opened. As such, the second embodiment has an advantage that a large amount of liquid can be lifted in one liquid lifting operation cycle in comparison with the first embodiment.

Third Embodiment

Figure 8:
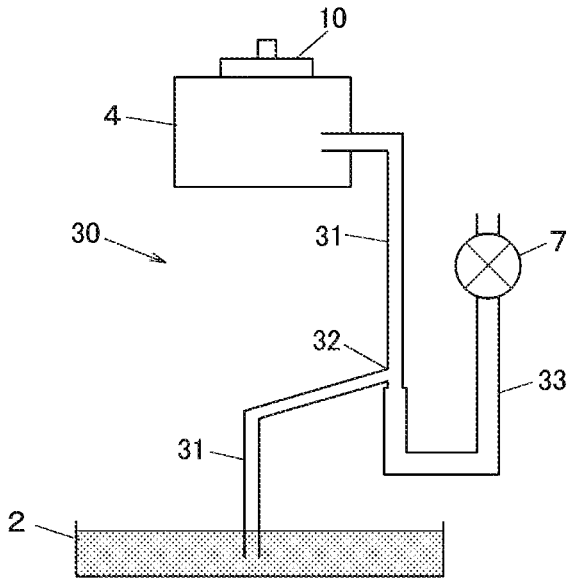
FIG. 8 is a schematic diagram illustrating a third embodiment of a liquid lifting device according to the present disclosure.

FIG. 8 illustrates a third embodiment of a liquid lifting device according to the present disclosure. A device 30 is a variation on the device 20 of the second embodiment, and the same constituent elements as those in the device 20 of the second embodiment are given the same reference numerals and redundant descriptions thereof will be omitted.

The device 30 is characterized in that a cross-sectional area of an air supply pipe 33 is larger than that of a liquid lifting pipe 31. Since a volume of the interior of the air supply pipe 33 is large, a large air layer can be formed within the liquid lifting pipe 31. This makes it easy to divide liquid in the liquid lifting pipe 31 into upper and lower side liquids, thereby enhancing the effect of liquid lifting operation. A reference numeral of 32 denotes a branching section. The structure in which the cross-sectional area of the air supply pipe 33 is larger than that of the liquid lifting pipe 31 can be applied to the liquid lifting device of the first embodiment (FIG. 1).

Fourth Embodiment

Figure 9:
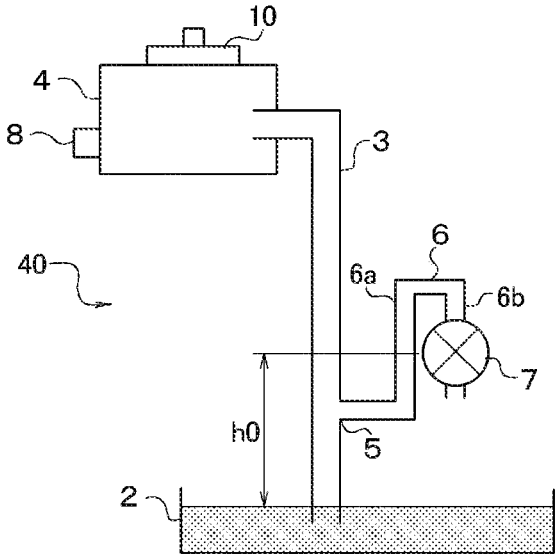
FIG. 9 is a schematic diagram illustrating a fourth embodiment of a liquid lifting device according to the present disclosure.
Figure 10:
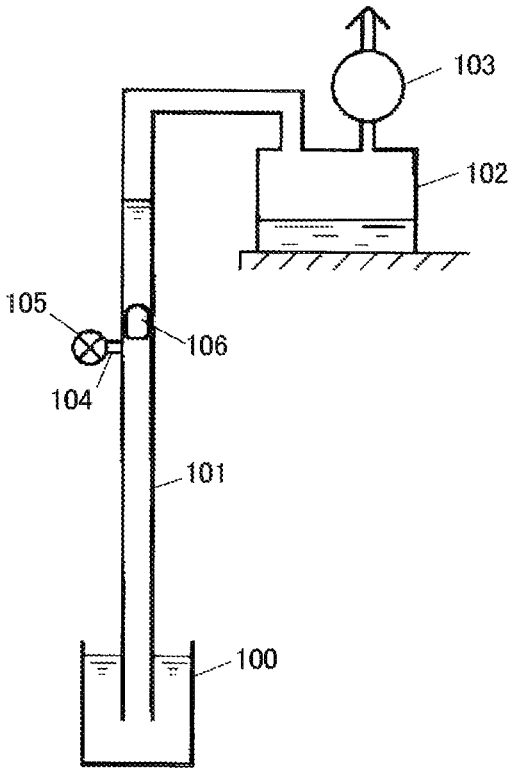
FIG. 10 is a schematic diagram illustrating an example of an existing liquid lifting device.
Figure 11:
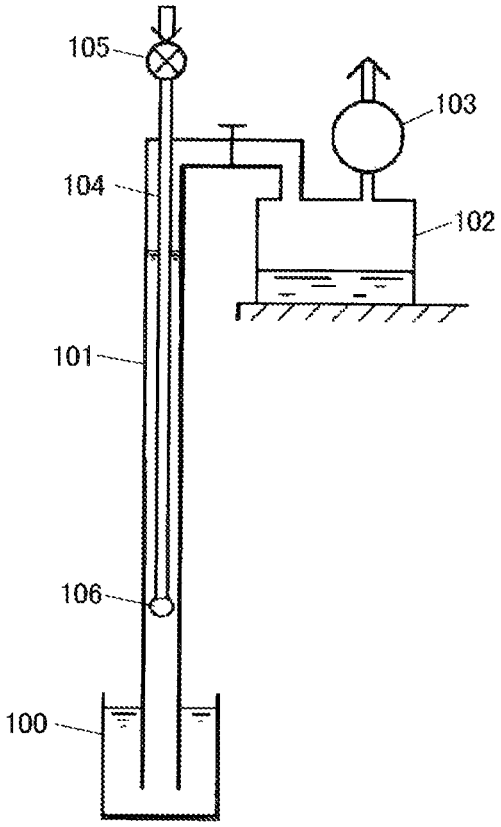
FIG. 11 is a schematic diagram illustrating another example of an existing liquid lifting device.

FIG. 9 illustrates a fourth embodiment of a liquid lifting device according to the present disclosure. A device 40 is a variation on the device 1 of the first embodiment, and the same constituent elements as those in the first embodiment are given the same reference numerals and redundant descriptions thereof will be omitted.

The device 40 is characterized in that the other end side of the air supply pipe 6 is made to stand upright and subsequently is bent so as to face downward, and then the air valve 7 is attached to a downward-facing section 6*b* thereof. In this case, if an upper end of the upright section 6*a* is positioned higher than the potential liquid lifting height h0 by the air pump 10, liquid cannot flow over the upright section 6*a*. With this, liquid will not make contact with the air valve 7 even if the air valve 7 is attached at a position lower than the potential liquid lifting height h0. The structure of the device 40 can be applied to the second embodiment and the third embodiment.

REFERENCE SIGNS LIST

1 LIQUID LIFTING DEVICE
2 LIQUID SUPPLY SECTION
3 LIQUID LIFTING PIPE
4 TANK

5 BRANCHING SECTION
6 AIR SUPPLY PIPE
6*a* UPRIGHT SECTION
7 AIR VALVE
8 LIQUID LEVEL SENSOR
10 AIR PUMP (MICRO BLOWER)
13*c* DISCHARGE OUTLET
19*a* SUCTION INLET

The invention claimed is:

1. A liquid lifting device comprising:

a liquid supply section in which liquid is stored;

a tank provided at a position which is higher than the liquid supply section;

a liquid lifting pipe of which one end is inserted into the liquid stored in the liquid supply section and the other end is connected to the tank;

an air pump configured to depressurize an interior of the tank and an interior of the liquid lifting pipe, wherein the air pump includes a suction inlet and a discharge outlet communicating with each other when the air pump is not driven;

an air supply pipe of which one end portion is connected to the liquid lifting pipe via a branching section at a position halfway in the liquid lifting pipe, wherein an upright section is provided in the other end portion of the air supply pipe while the upright section stands upright from the one end portion; and an air valve provided in the other end portion of the air supply pipe and configured to open/close with respect to the outside air, wherein a height from a liquid surface in the liquid supply section to the other end of the liquid lifting pipe is larger than a potential liquid lifting height of the air pump, a height from the liquid surface in the liquid supply section to the branching section is smaller than the potential liquid lifting height of the air pump, the liquid lifting pipe comprises a lower section and an upper section, the one end portion of the air supply pipe is connected in a straight line to the upper section of the liquid lifting pipe on the tank side via the branching section, and the lower section is bent away from the upper section at the branching section.

2. The liquid lifting device according to claim 1, wherein the upright section of the air supply pipe extends up to a position higher than the potential liquid lifting height of the air pump, and the air valve is attached to the upright section at a position higher than the potential liquid lifting height of the air pump.

3. The liquid lifting device according to claim 1, wherein the one end portion and the other end portion of the air supply pipe respectively stand upright and comprise approximately a U shape as a whole.

4. The liquid lifting device according to claim 1, wherein a cross-sectional area of the air supply pipe is larger than a cross-sectional area of the liquid lifting pipe.

5. A liquid lifting method configured to use a liquid lifting device including:

a liquid supply section in which liquid is stored;

a tank provided at a position which is higher than the liquid supply section;

a liquid lifting pipe of which one end is inserted into the liquid stored in the liquid supply section and the other end is connected to the tank;

an air pump configured to depressurize an interior of the tank and an interior of the liquid lifting pipe, wherein the air pump includes a suction inlet and a discharge outlet communicating with each other when the air pump is not driven;

an air supply pipe of which one end portion is connected to the liquid lifting pipe via a branching section at a position halfway in the liquid lifting pipe, wherein an upright section is provided in the other end portion of the air supply pipe while the upright section stands upright from the one end portion; and an air valve provided in the other end portion of the air supply pipe and configured to open/close with respect to the outside air, wherein a height from a liquid surface in the liquid supply section to the other end of the liquid lifting pipe is larger than a potential liquid lifting height of the air pump, a height from the liquid surface in the liquid supply section to the branching section is smaller than the potential liquid lifting height of the air pump, the liquid lifting pipe comprises a lower section and an upper section, the one end portion of the air supply pipe is connected in a straight line to the upper section of the liquid lifting pipe on the tank side via the branching section, and the lower section is bent away from the upper section at the branching section, the method comprising:

a first step of driving the air pump while closing the air valve so as to lift the liquid stored in the liquid supply section up to a position above the branching section in the liquid lifting pipe; and a second step of opening the air valve while driving the air pump so as to introduce an air layer into the branching section through the air supply pipe, dividing the liquid in the liquid lifting pipe into upper and lower side liquids by the air layer, and pumping up the liquid positioned above the air layer into the tank.

6. The liquid lifting method according to claim 5 further comprising a step of keeping the air valve open continuously until the liquid positioned above the air layer has been pumped up into the tank.

* * * * *